United States Patent [19]

Baer et al.

[11] 4,012,836

[45] Mar. 22, 1977

[54] CARTON KNIFE

[75] Inventors: Richard I. Baer, Monson; Kenneth M. Bellivue, Granly, both of Mass.

[73] Assignee: Safe-T-Cut Incorporated, Palmer, Mass.

[22] Filed: May 30, 1975

[21] Appl. No.: 582,230

[52] U.S. Cl. ..... 30/2; 30/320; 30/335

[51] Int. Cl.[2] ..... B26B 1/08; B26B 5/00

[58] Field of Search ..... 30/2, 162, 294, 320, 30/335, 336

[56] References Cited

UNITED STATES PATENTS

| | | | |
|---|---|---|---|
| 2,282,697 | 5/1942 | Bates | 30/2 |
| 2,404,141 | 7/1946 | Nelson | 30/162 |
| 3,063,147 | 11/1962 | Paparelli | 30/320 X |
| 3,192,624 | 7/1965 | Gringer | 30/162 |
| 3,879,847 | 4/1975 | Roll | 30/162 |

*Primary Examiner*—Al Lawrence Smith
*Assistant Examiner*—Gary L. Smith
*Attorney, Agent, or Firm*—Jerry Cohen; Charles Hieken

[57] ABSTRACT

A knife for cutting cartons comprises a movable blade carrier, and blade, mounted in a stepped guide for positive blade location at any of a plurality of selected locations, within a handle having an extended area lip feeler adjacent a handle opening such that the blade may be presented through said opening in any of a plurality of lengths corresponding essentially to the thickness or thinness of a carton wall so that the knife cuts the carton and not its contents, consistent with safety for the operator, economy of manufacture and use and compactness.

4 Claims, 6 Drawing Figures

CARTON KNIFE

BACKGROUND OF THE INVENTION

The present invention relates to cutting implements and more particularly to a knife for cutting open shipping cartons. It is a particular aspect of the present invention that it may be used to reliably and quickly cut open cartons without damaging their contents consistent with safety for the operator, economy of manufacture and use and compactness.

Shipping cartons have a variety of closure techniques involving substantial use of tapes and/or adhesives, the removal of which tax the time, patience, ingenuity and/or strength of receiving personnel. When the actual closure of a carton is avoided in opening by cutting away a whole wall of a carton with conventional knives, razors, matt knives or other general purpose tools, the efficiency is limited and the dangers to receiving personnel are high.

It is an important object of the invention to provide carton opening with improved safety for personnel.

It is a further object of the invention to provide a carton knife which guides the person opening the carton to locate a cutting line for removing a whole face of a carton (including within the term "carton" throughout this specification any form of shipping package of any cuttable material), consistent with the preceding object.

It is a further object of the invention to provide positive blade location for setting a depth of cut corresponding to the thickness of the carton wall which is to be cut through, consistent with one or both of the preceding objects.

It is a further object of the invention to provide a compact device which can fit in a persons pocket and easily within the hand, consistent with one or more of the preceding objects.

It is a further object of the invention to accommodate use of standard blades, to allow reversability of blade and/or to allow blade replacement, consistent with one or more of the preceding objects.

It is a further object of the invention to provide an economically manufacturable carton knife, consistent with one or more of the preceding objects.

SUMMARY OF THE INVENTION

In accordance with the invention, a carton knife comprises a blade, a movable blade carrier and a handle supporting the movable blade carrier, the handle comprising a stepped guide for locked establishment of several distinct positions of the carrier (and, hence of the blade). The handle contains the carrier and blade within a recess thereof which has an opening and the handle further comprises an extended area lip feeler adjacent such opening and running parallel to the direction of blade extension through the opening so that the feeler can be set upon a carton surface to be cut away and so that the handle can be drawn along an edge of such surface undercutting such surface with the extended blade (which cuts through the next adjacent carton wall) and repeating this process at every edge of the surface to be cut away until it is free from the carton. The movable blade carrier and lockable guide are used to establish a blade extension distance through said opening corresponding to the thickness of the wall being cut so that the blades cut such wall and not the contents of the carton. A further rib extends orthogonal to the feeler lip to complete the establishment of a stable cutting arrangement while bearing down in a cutting stroke.

The movable blade carrier preferably comprises a U-shaped flexible member with an integral thumb contact for pushing it into and out of contact with locking detents provided on the handle. Direction guiding fins and/or corresponding grooves are provided in each of the handle and carrier to guide the blade carrier and to contain the blade between closely spaced parallel surfaces of the carrier and handle groove for stiffening of the blade.

Both the handle and carrier are preferably made of structural plastics, such as ABS, PVC, polypropylene, or the like, but may be made alternatively of wood or metal or other materials providing that low friction, close-fitting of guiding parts is provided either through inherent lubricating properties of the material selected or through coating of the surfaces thereof with a lubricating agent. In using the above-mentioned plastics, no lubricating coating need be provided since such plastics are self lubricating for the context of the present invention.

According to a further aspect of the invention, the blade carrier itself can be removed through the above mentioned opening for blade replacement.

Other objects, features and advantages of the invention will be apparent from the following detailed description of preferred embodiments taken in connection with the accompanying drawing in which:

BRIEF DESCRIPTION OF THE DRAWING

FIG. 5 is viewed in the same direction as FIG. 2.

DETAILED DESCRIPTION OF PREFERRED EMBODIMENTS

Figure 1:
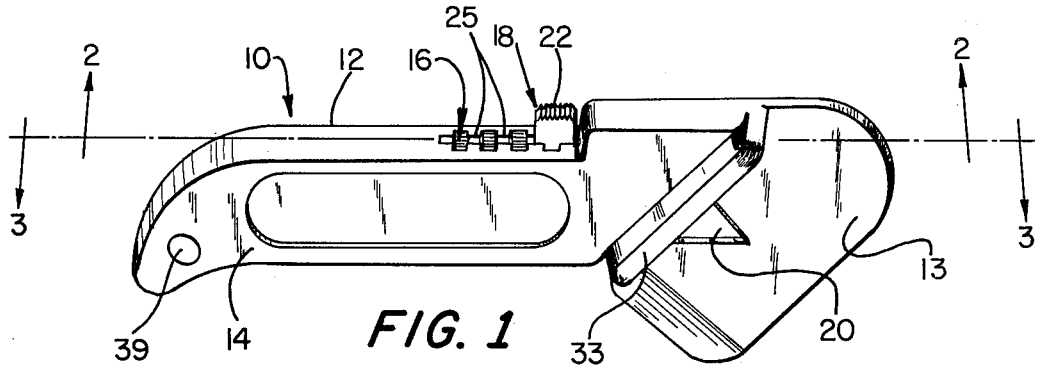
FIG. 1 is an isometric view of the carton knife, assembled.

Referring now to FIG. 1, the carton knife 10 comprises a handle 12 with an extended feeler lip guide 13 and a rear hand held portion 14 having an internal groove 15 with a top opening 16 for adjustments of blade length (as described below) and a front opening 17 for blade extension. A blade carrier subassembly 18 slides in the groove 15 and carries a conventional blade 20 of the type ordinarily used in matt knives and the like. The blade carrier 18 is of generally U-shaped form and has a thumb switch which may be pressed to control the position for locking keys 24 thereon relative to locking detents 26 contained along the edges of opening 16. A high clearance is provided at section 28 of the groove 15 so that thumb switch 22 can slide thereunder to allow removal of entire assembly 18 through opening 17. However, this is only for blade replacements (or replacement of the entire blade carrier) and usual operation does not entail such complete removal.

The handle 12 has elongated longitudinal grooves 32 in the sidewall of its internal groove 15 which accommodate external ribs 34 of the blade carrier in sliding engagement. Such ribs also define the location of blade 20 and lock it against movement, together with a pin 36 which is accommodated in groove 38 during movement of the blade carrier 18 through a plurality of preselected positions which may be locked by engaging locking keys 24 in a set of grooves 26 defined between locking detents 25.

Additional ribs 38 on blade carrier 18 butt against wall 37 within groove 15 to provide an overall stiff support of the blade carrier and blade in any of its locked positions so that the blade will transmit cutting force of the operators hand to effective cutting action on a carton. A rib 33 on the handle extends orthogonally to lip 13 and together therewith stabilizes the blade during cutting to prevent lateral displacement in response to the shifting forces applied during a cutting stroke.

Figure 6:
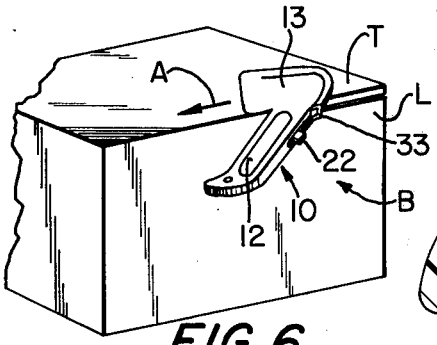
FIG. 6 is an isometric sketch of a carton being opened by the FIG. 1–5 knife.
Figure 2:
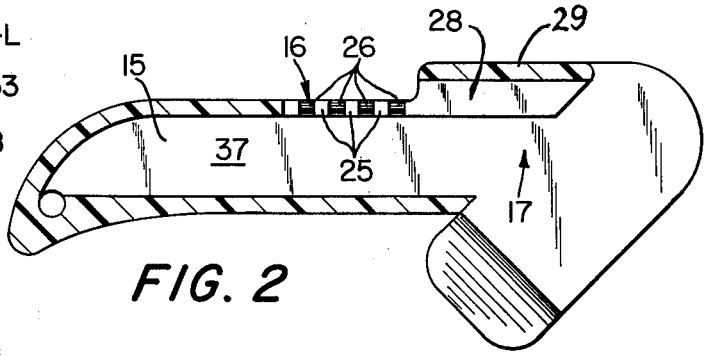
FIGS. 2 and 3 are section drawings of the handle, with the blade carrier and blade removed, such sections being taken as indicated by the arrows 2—2 and 3—3 in FIG. 1.
Figure 3:
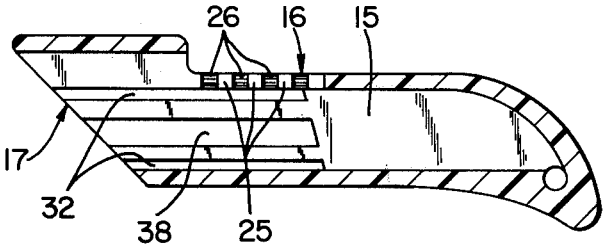
Figure 4:
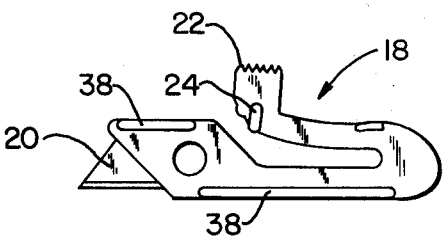
FIGS. 4 and 5 are corresponding side views of the blade carrier and blade taken in directions to that FIG. 4 is viewed in the same direction as FIG. 3
Figure 5:
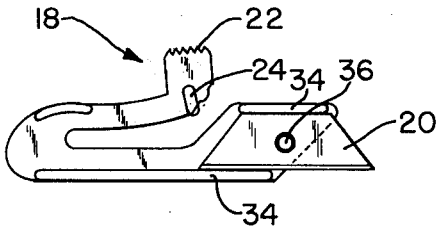

Referring now to FIG. 6, the carton knife of the invention, 10, is shown in action cutting the top surface T from a carton B by moving the knife in the direction indicated by arrow A while the feeler lip guide 13 and rib 33 bear against surface T to define cutting location L at a uniform distance from surface T going around the four sides of the carton B in a stable arrangement. And as discussed above, the extension of blade 20 beyond opening 17 of handle 12 can be controlled by use of thumb switch 22 so that such extension is not significantly deeper than the thickness of the side(s) being cut through so that cutting of the carton contents is avoided.

It will be observed that the handle construction as a whole shields the blade from the operator to avoid self-inflicted wounds and that the arrangement is one for the effective application of cutting forces, allowing a good grip of forehands and closed fist around handle 12 and, if desired, bearing down with the thumb on the top of lip 13 to apply extra cutting force and maintain firm orientation of part involved — the carton and the knife. The blade 20 may be completely retracted using the thumb switch 22 and the blade can be left in a pocket with complete safety. The blade carrier 20 can be removed to allow blade replacement or reversal on pin 36. Each of the handle 12 and blade carrier 18 can be made as a one-piece molded assembly and a hole 39 can be also included in handle 12 for hanging from a nail or peg on a wall or placement on a pin of display rack.

According to a further embodiment of the invention thumb switch 22 can be made of more extended length than shown in FIGS. 1 and 4–6, adding a rear extension to the switch as shown and a corresponding rear extension of groove 16. The effect of such extension is that when blade holder 18 is extended sufficiently forward so blade 20 completely clears opening 17 (e.g. for blade changing), the operator can still work the position of holder 18 by pressing on (the rear extension of) switch 22 rather than pushing on the front end of holder 18 to return it rearwardly to the normal range of locked operating positions. This provides added convenience, speed and safety to the operator.

It will be understood that when the holder 18 is moved the legs of its U-shape compress towards each other and that enough space is provided between the legs to drop the keys 24 into a different longitudinal path and/or to drop switch 22 into a lower height envelope of the holder, as a whole. when the holder moves through the forward part (high clearance section) 28 of handle 12, switch 22 butts up against the roof 29 of such section to prevent expansion to a locking position.

It should be understood that while in all the above described embodiments the U-shaped holder is compressed inwardly for lock clearance and free longitudinal movement and expanded outwardly for locking, the reverse arrangement or other variant may be employed within the scope of the invention.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Carton knife comprising, means defining a hand holdable handle member with an extended length and an extended length hole therein with a forward opening, means defining a blade carrier for moving along the length of said hole, means for moving the carrier between and locking it in any one of a plurality of discrete positions along the length of said internal hole, the said blade carrier means carrying a blade in position to extend forwardly through said hole forward opening in several of said plurality of positions and to be completely recessed within said hole in at least one of said positions, the said hole and blade carrier further comprising cooperating guide means for rigidly mounting said blade and providing a smooth longitudinal passage track for said blade carrier within said hole, the forward part of the hole having a roof to prevent expansion of the carrier to a locking position, the said handle further comprising external guide means for bearing against two sides of a carton to define a uniform location of cut of a carton close to the edge of one of said sides at a depth of cut defined by the degree of extension of this blade through said opening, and wherein said blade carrier is of flexible U-shaped form with a base of the U at the rear of the blade carrier and mounting means for the blade in front of the carrier.

2. Carton knife in accordance with claim 1 wherein said hole and blade carrier further define a position for allowing removal of said blade carrier from said hole.

3. Carton knife in accordance with claim 1 wherein said locking means comprise a second lateral opening of the handle accessing said hole and comprising locking detents therein, said blade carrier having corresponding locking keys for engaging said detents in any of a plurality of locking relations and manually actuatable means extending through said second opening for defining engagement and disengagement of said keys and detents and allowing control of position of the blade carrier within the hole when the keys and detents are disengaged.

4. Carton knife in accordance with claim 1 wherein each of said blade carrier and handle are of one-piece molded construction.

* * * * *